US007172449B2

(12) United States Patent
Shindo et al.

(10) Patent No.: US 7,172,449 B2
(45) Date of Patent: Feb. 6, 2007

(54) CONNECTOR APPARATUS EASY IN REMOVING OPERATION

(75) Inventors: Takeshi Shindo, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/258,254

(22) Filed: Oct. 25, 2005

(65) Prior Publication Data

US 2006/0089037 A1 Apr. 27, 2006

(30) Foreign Application Priority Data

Oct. 27, 2004 (JP) ..... 2004-312366

(51) Int. Cl.
*H01R 4/50* (2006.01)

(52) U.S. Cl. ..... 439/341; 439/65

(58) Field of Classification Search ..... 439/65–69, 439/74, 296, 341
See application file for complete search history.

(56) References Cited

U.S. PATENT DOCUMENTS 5,674,078 A * 10/1997 Davis et al. ..... 439/79
6,120,328 A * 9/2000 Bricaud et al. ..... 439/630
6,503,093 B1 * 1/2003 Sakata et al. ..... 439/328
6,537,086 B1 * 3/2003 Mac Mullin ..... 439/79

FOREIGN PATENT DOCUMENTS

| | | |
|---|---|---|
| EP | 0795929 A | 9/1997 |
| EP | 0814645 | 12/1997 |
| EP | 1313176 | 5/2003 |
| WO | WO 98/09345 | 3/1998 |

OTHER PUBLICATIONS

European Search Report.

* cited by examiner

*Primary Examiner*—Khiem Nguyen
(74) *Attorney, Agent, or Firm*—Collard & Roe, P.C.

(57) ABSTRACT

In a connector apparatus including a first connector and a second connector to be fitted to the first connector in a predetermined direction, the first connector includes a conductive receptacle contact having first and second receptacle-side contact points spaced from each other. The first receptacle-side contact point and the second receptacle-side contact point are positioned in this order towards the predetermined direction. The second connector includes a conductive plug contact to be inserted between the first and the second receptacle-side contact points. The plug contact has an inserting end, first and second plug-side contact points to be contacted with the first and the second receptacle-side contact points, respectively, and a protruding portion formed between the inserting end and the first plug-side contact point.

13 Claims, 3 Drawing Sheets

CONNECTOR APPARATUS EASY IN REMOVING OPERATION

This application claims priority to prior Japanese application JP 2004-312366, the disclosure of which is incorporated herein by reference.

BACKGROUND OF THE INVENTION

The present invention relates to a connector apparatus including two connectors to be fitted and connected to each other.

As one type of a connector for connecting a cable to a circuit board, a connector apparatus of a so-called stacking type is known. The connector apparatus of the type comprises a receptacle connector to be mounted to the board and a plug connector connected to a cable and adapted to be fitted and connected to the receptacle connector in a stacked state. The receptacle connector has a receptacle contact. The plug connector has a plug contact. When the plug connector is connected to the receptacle connector, the plug contact is contacted with and fitted to the receptacle contact.

The cable may be extracted from the plug connector in a direction substantially parallel to the board. In this case, if the cable is pulled in a direction away from the board, the plug connector is rotated and separated from the receptacle connector. At this time, the plug contact is inclined and strongly engaged with the receptacle contact. As a result, the connector apparatus may possibly be broken. Thus, if the cable is erroneously pulled, the connector apparatus may possibly be broken.

SUMMARY OF THE INVENTION

It is therefore an object of this invention to provide a connector apparatus including two connectors easily removable from each other without the possibility of breakage.

It is another object of this invention to provide a connector easily removable from a mating connector with rotational movement.

Other objects of the present invention will become clear as the description proceeds.

According to an aspect of the present invention, there is provided a connector apparatus including a first connector and a second connector to be fitted to the first connector in a predetermined direction, wherein the first connector includes a conductive receptacle contact having first and second receptacle-side contact points spaced from each other, the first receptacle-side contact point and the second receptacle-side contact point being positioned in this order towards the predetermined direction, the second connector including a conductive plug contact to be inserted between the first and the second receptacle-side contact points, the plug contact having an inserting end, first and second plug-side contact points to be contacted with the first and the second receptacle-side contact points, respectively, and a protruding portion formed between the inserting end and the first plug-side contact point.

DESCRIPTION OF THE PREFERRED EMBODIMENT

DESCRIPTION OF THE PREFERRED EMBODIMENT

Figure 1:
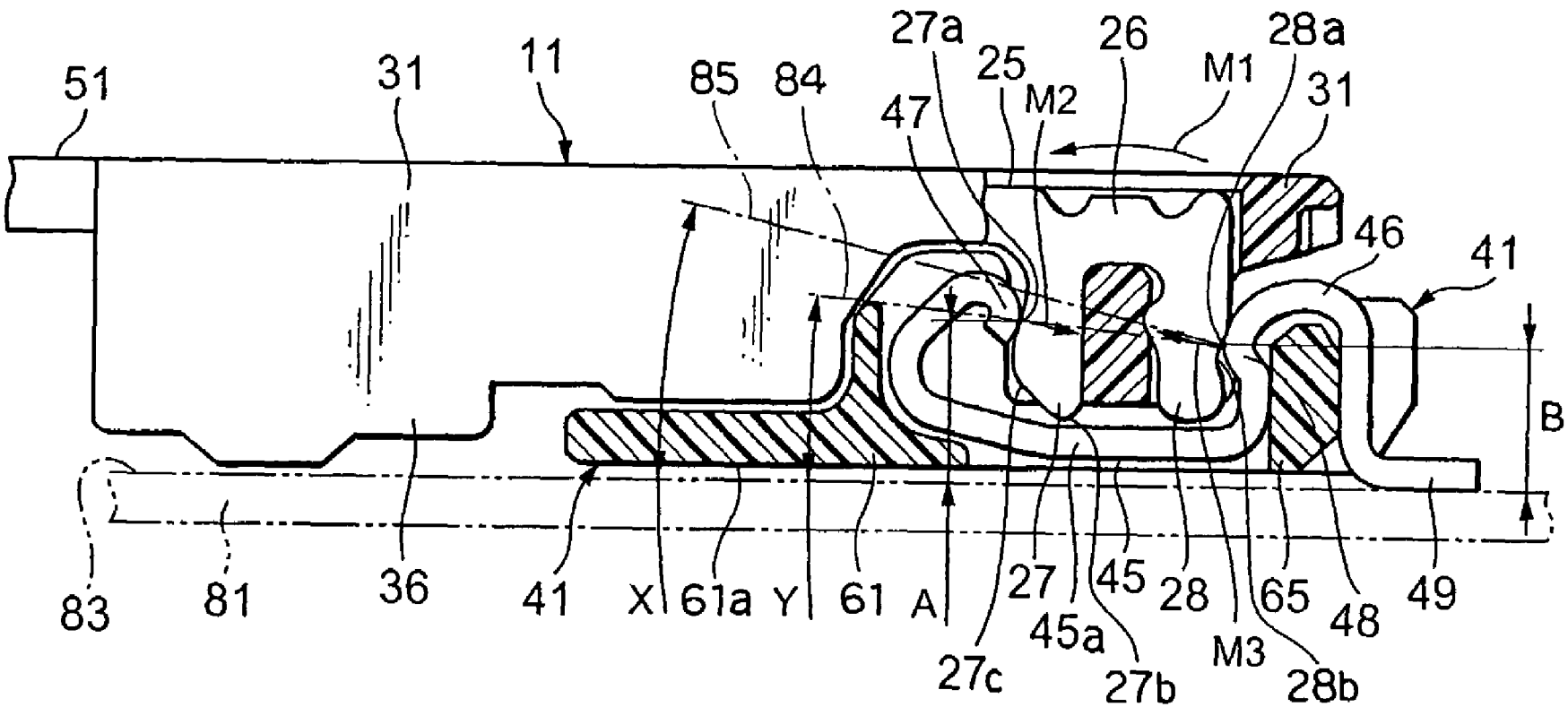
FIG. 1 is a partial sectional view of a connector apparatus according to an embodiment of this invention in a fitted state.
Figure 2:
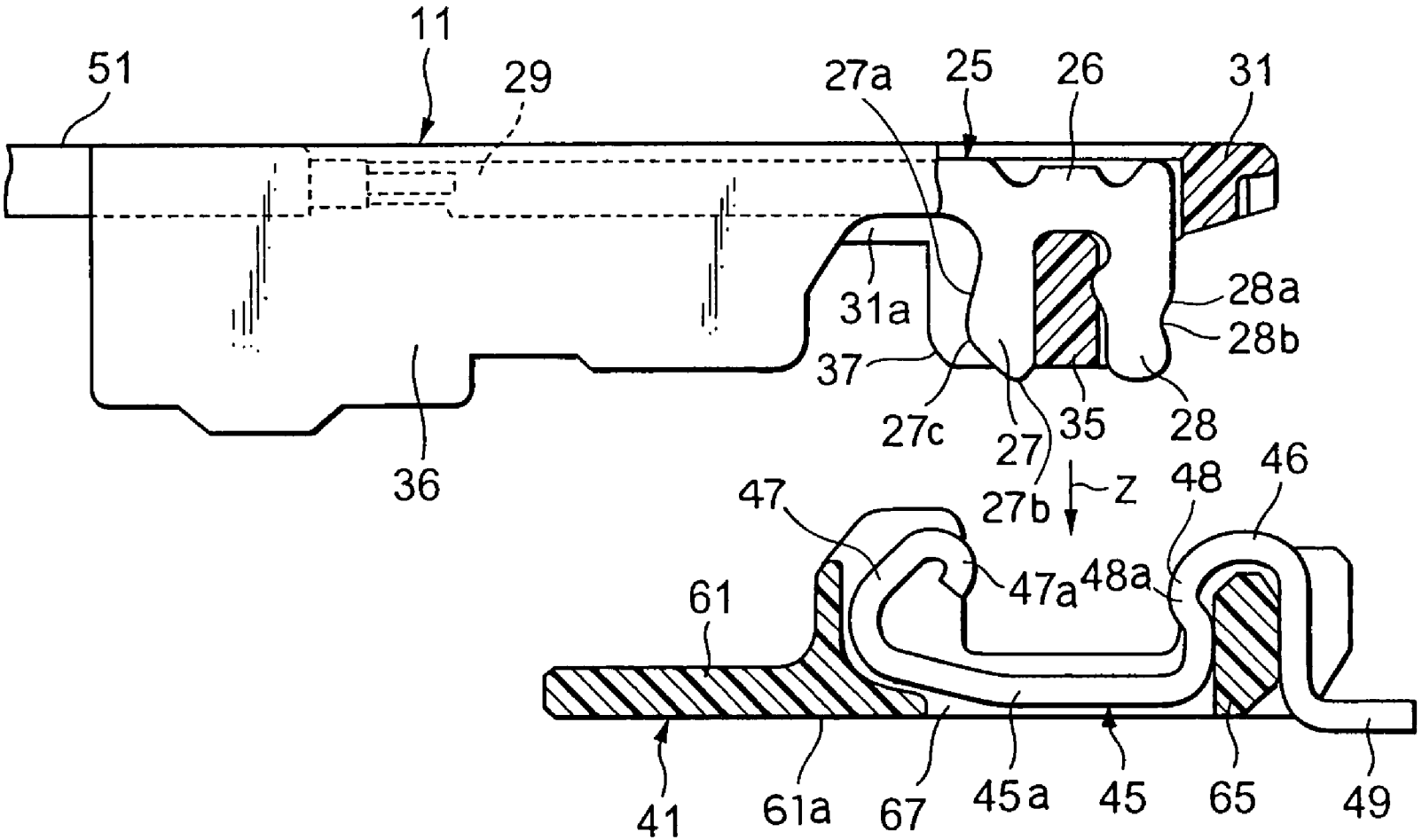
FIG. 2 is a partial sectional view of the connector apparatus in FIG. 1 when two connectors are separated from each other.

Referring to FIGS. 1 and 2, description will be made of a connector apparatus according to an embodiment of this invention.

The connector apparatus illustrated in the figure comprises a plug connector (second connector) 11 and a receptacle connector (first connector) 41 adapted to be fitted to and removed from each other. The plug connector 11 comprises a plurality of conductive plug contacts 25 and an insulator 31 holding the plug contacts 25 in the vicinity of one end thereof. For convenience of the drawing, only one of the plug contacts 25 is shown in the figures. Each of the plug contacts 25 has a holding portion 26, a first plug-side contacting part 27 extending from one side of the holding portion 26 in a predetermined direction, i.e., a connecting direction Z, and a second plug-side contacting part 28 faced to the first plug-side contacting part 27 and extending in the connecting direction Z. In FIGS. 1 and 2, a combination of the holding portion 26 and the first and the second plug-side contacting parts 27 and 28 forms a generally inverted U-shaped portion.

The first plug-side contacting part 27 has a first plug-side contact point 27*a*, an inserting end 27*b* as a forward end in the connecting direction Z, and a protruding portion 27*c* formed between the inserting end 27*b* and the first plug-side contact point 27*a*. The protruding portion 27*c* is adjacent to the first plug-side contact point 27*a* and protrudes from the first plug-side contact point 27*a*. The protruding portion 27*c* is defined by a gently curved surface extending in the connecting direction Z as a whole. The second plug-side contacting part 28 has a second plug-side contact point 28*a*. A recessed portion 28*b* is formed at the plug-side contact point 28*a* or in the vicinity thereof. The first plug-side contact point 27*a* is positioned upstream or backward in the connecting direction Z (upper side in FIG. 2) with respect to the second plug-side contact point 28*a*. In other words, the first plug-side contact point 27*a* and the second plug-side contact point 28*a* are positioned in this order towards the connecting direction Z.

The curved surface defining the protruding portion 27*c* preferably has a part along an arc centered on the second plug-side contact point 27*a* or an arc having a smaller radius.

The insulator 31 has a holding wall portion 35 press-fitted into the generally inverted U-shaped portion, a cable 51 connected to the plug contacts 25, and a cover portion 36 covering cable holding portions 29 of the plug contacts 25. The cable 51 is extracted from the other end of the insulator 31.

A combination of the holding wall portion 35 of the insulator 31, the holding portions 26 of the plug contacts 25, the first and the second plug-side contacting parts 27 and 28 forms a fitting portion 37 to be fitted and connected to the receptacle connector 41 in the connecting direction Z.

The receptacle connector 41 has a plurality of conductive receptacle contacts 45 and an insulator 61 holding the receptacle contacts 45. For convenience of the drawing, only one of the receptacle contacts 45 is shown in the figures. Each of the receptacle contacts 45 has a first receptacle-side contacting part 47, a second receptacle-side contacting part 48 faced to the first receptacle-side contacting part 47 with a space kept therefrom, a holding portion 46 continuous from the second receptacle-side contacting part 48, and a terminal portion 49 continuous from the holding portion 46 to be connected to a board 81. The first receptacle-side contacting part 47 has a first receptacle-side contact point 47*a* to be contacted with the first plug-side contact point 27*a*. The second receptacle-side contacting part 48 has a second receptacle-side contact point 48*a* to be contacted with the second plug-side contact point 28*a*. The first and the second receptacle-side contact points 47*a* and 48*a* are spaced from each other.

In addition, the insulator 61 has a mounting surface 61*a* flat and perpendicular to the connecting direction Z. On the other hand, the terminal portion 49 continuous from the holding portion 46 and protrudes from the mounting surface 61*a* of the insulator 61.

The first and the second receptacle-side contact points 47*a* and 48*a* are formed at positions shifted from each other in the connecting direction Z along which the receptacle connector 41 is connected to the plug connector 11. Specifically, the first receptacle-side contact point 47*a* is positioned upstream or backward (upper side in FIG. 2) in the connecting direction Z with respect to the second receptacle-side contact point 48*a*. In other words, the first receptacle-side contact point 47*a* and the second receptacle-side contact point 47*b* are positioned in this order towards the connecting direction Z. Thus, when the plug connector 11 and the receptacle connector 41 are fitted to each other, the first plug-side contacting part 27 is contacted with the first receptacle-side contacting part 47 at a position forward in a removing direction opposite to the connecting direction Z with respect to a position where the second plug-side contacting part 28 is contacted with the second receptacle-side contacting part 48.

Each of the receptacle contacts 45 further has an elastically-deformable spring portion 45*a* extending between the first and the second receptacle-side contacting parts 47 and 48. When the plug connector 11 and the receptacle connector 41 are fitted to each other and each plug contact 25 and each receptacle contact 45 are connected to each other, the first plug-side contacting part 27 is press-contacted with the first receptacle-side contacting part 47 so that the spring portion 45*a* is elastically displaced.

In the receptacle connector 41, the insulator 61 has a holding wall portion 65 holding the holding portion 46 of each receptacle contact 45, and a fitting portion 67. In the fitting portion 67, the spring portion 45*a*, the first receptacle-side contacting part 47, and the second receptacle-side contacting part 48 of each receptacle contact 45 are accommodated so as to be displaceable.

Herein, the fitting portion 37 of the plug connector 11 is a part protruding from a base portion 31*a* of the insulator 31 towards one side. The fitting portion 67 of the receptacle connector 41 has a hole-like or a groove-like shape so as to receive the fitting portion 37 in the connecting direction Z and to be fitted thereto.

In FIG. 1, M1 represents a moment applied when the plug connector 11 is fitted to the receptacle connector 41. Specifically, the plug connector 11 is rotated with respect to the receptacle connector 41 around the second plug-side contact point 28*a* as a support point so that the plug connector 11 and the receptacle connector 41 are fitted to each other. When the plug connector 11 is fitted to the receptacle connector 41, a moment M2 is applied to the first plug-side contact point 27*a* and a moment M3 is applied to the second plug-side contact point 28*a*.

In order to remove the plug connector 11 form the receptacle connector 41, the cable 51 may be pulled up. In this event, the second plug-side contact point 28*a* serves as a support point sliding along the second receptacle-side contacting part 48. Thus, the plug connector 11 is rotated around a position near the second plug-side contacting part 28 as a rotation center C. Herein, the rotation center C is positioned at an upper part of the holding wall portion 65.

Figure 3:
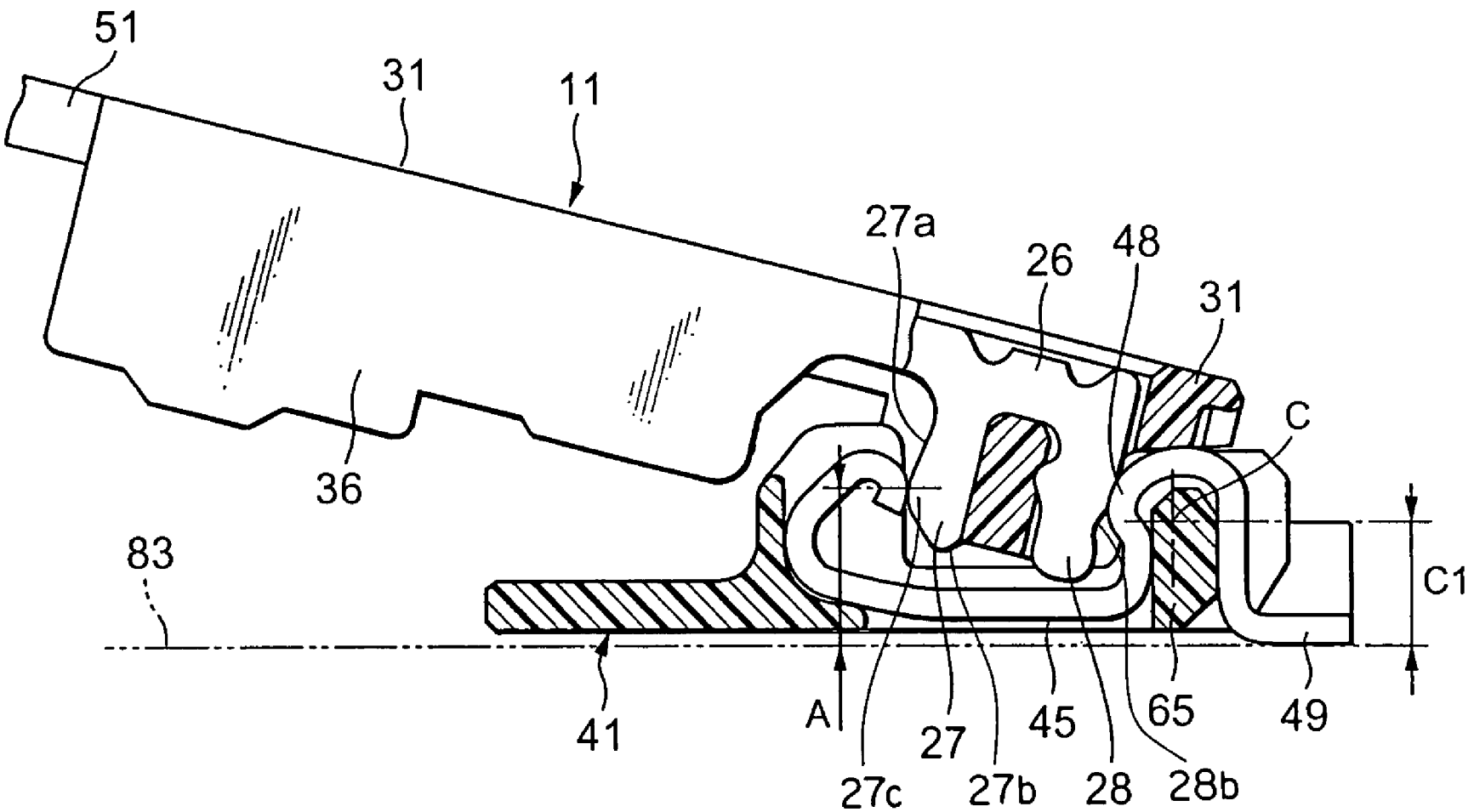
FIG. 3 is a partial sectional view of the connector apparatus in FIG. 1 during an operation of removing the two connectors from each other.

The receptacle connector 41 may be mounted to the printed circuit board 81 as a mounting object. Referring to FIGS. 1 and 3, description will be made of the relationship between a reference plane 83 of the circuit board 81 and the plug connector 11 in such a state.

The terminal portion 49 of the receptacle contact 45 is connected to a conductive portion (not shown) of the circuit board 81 by soldering. In the fitted state of the plug connector 11 and the receptacle connector 41 illustrated in FIG. 1, the height A of a first contacting portion between the first plug-side contact point 27*a* and the first receptacle-side contact point 47*a* from the reference plane 83 is higher than the height B of a second contacting portion between the second plug-side contact point 28*a* and the second receptacle-side contact point 48*a* from the reference plane 83. The height C1 of the rotation center C of the plug connector 11 from the reference plane 83 is lower than the height A of the first contacting portion.

The first and the second receptacle-side contact points 47*a* and 48*a* are arranged on a first plane 84 when the first connector 41 is mounted on a reference plane 83. An angle formed by the first plane 84 and the reference plane 83 is represented by Y. On the other hand, the first and the second plug-side contact points 27*a* and 28*a* are arranged on a second plane 85 when the second connector 11 is fitted to the first connector 41. An angle formed by the second plane 85 and the reference plane 83 is represented by X. In FIG. 1, it is to be noted that the angle X is greater than the angle Y.

When the plug connector 11 is rotated to be removed from the receptacle connector 41, the angle between the second plane 85 and the reference plane 83 becomes greater than the angle X. Since the height C1 of the rotation center C is lower than the height A of the first contacting portion, an angle at which the plug connector 11 can be removed, for example, the angle Y can be designed to be small. Therefore, even if the cable 51 is pulled and the plug connector 11 is removed in an inclined position, a deflection amount of the spring portion 45*a* can be suppressed small. Accordingly, the spring portion 45*a* is prevented from fatiguing. Thus, the connector apparatus is prevented from breakage. In the fitted state, a cable side of the plug connector 11 is not lifted up.

The above-mentioned connector apparatus is applicable to a portable electronic apparatus such as a notebook-type personal computer.

Although this invention has thus far been described in conjunction with the preferred embodiment thereof, it will readily be possible for those skilled in the art to put this invention into practice in various other manners without departing the scope of the appended claims.

What is claimed is:

1. A connector apparatus including a first connector and a second connector to be fitted to the first connector in a predetermined direction, wherein:

the first connector includes a conductive receptacle contact having first and second receptacle-side contact points spaced from each other, the first receptacle-side contact point and the second receptacle-side contact point being positioned in this order towards the predetermined direction;

the second connector including a conductive plug contact to be inserted between the first and the second receptacle-side contact points, the plug contact having an inserting end, first and second plug-side contact points to be contacted with the first and the second receptacle-side contact points, respectively, and a protruding portion formed between the inserting end and the first plug-side contact point.

2. The connector apparatus according to claim 1, wherein the protruding portion is adjacent to the first plug-side contact point and protrudes from the first plug-side contact point.

3. The connector apparatus according to claim 1, wherein the protruding portion is defined by a gently curved surface extending in the predetermined direction as a whole.

4. The connector apparatus according to claim 3, wherein the curved surface extends continuously from the first plug-side contact point to the inserting end.

5. The connector apparatus according to claim 3, wherein the curved surface has a part along an arc.

6. The connector apparatus according to claim 5, wherein the arc is centered on the second plug-side contact point.

7. The connector apparatus according to claim 1, wherein the plug contact has a recessed portion corresponding to the second plug-side contact point, the second receptacle-side contact point having a shape engageable with the recessed portion.

8. The connector apparatus according to claim 1, wherein the receptacle contact has a spring portion elastically connecting the first and the second receptacle-side contact points.

9. The connector apparatus according to claim 1, wherein the first connector further has an insulator holding the receptacle contact, the insulator having a mounting surface flat and perpendicular to the predetermined direction, the receptacle contact further having a terminal portion extending from the second receptacle-side contact point and protruding from the mounting surface.

10. A connector removable from a mating connector with rotational movement, comprising:

a conductive plug contact to be inserted between a pair of contact points of the mating connector in a predetermined direction; and an insulator holding the plug contact;

the plug contact having:

an inserting end;

first and second plug-side contact points to be contacted with the contact points, respectively; and a protruding portion formed between the inserting end and the first plug-side contact point;

the protruding portion being adjacent to the first plug-side contact point and protruding from the first plug-side contact point, the protruding portion being defined by a gently curved surface extending in the predetermined direction as a whole;

the insulator being rotatable around the second plug-side contact point as a support point.

11. The connector apparatus according to claim 1, wherein the first and the second receptacle-side contact points are arranged on a first plane when the first connector is mounted on a reference plane, the first and the second plug-side contact points being arranged on a second plane when the second connector is fitted to the first connector, an angle between the second plane and the reference plane being greater than an angle between the first plane and the reference plane.

12. The connector apparatus according to claim 11, wherein the second connector is fitted to the first connector mounted on the reference plane, a height of the second receptacle-side contact point from the reference plane being lower than a height of the first receptacle-side contact point from the reference plane.

13. The connector apparatus according to claim 12, wherein the second connector is removable with rotational movement around a rotation center from the first connector, a height of the rotation center from the reference plane being lower than a height of the first receptacle-side contact point from the reference plane.

* * * * *